US006051128A

United States Patent [19]

Nacamuli et al.

[11] Patent Number: 6,051,128

[45] **Date of Patent: *Apr. 18, 2000**

[54] SPLIT-FEED TWO-STAGE PARALLEL AROMATIZATION FOR MAXIMUM PARA-XYLENE YIELD

[75] Inventors: Gerald J. Nacamuli, Mill Valley; Bruce J. Thom, Concord, both of Calif.

[73] Assignee: Chevron Chemical Company, San Ramon, Calif.

[ * ] Notice: This patent is subject to a terminal disclaimer.

[21] Appl. No.: 08/470,845

[22] Filed: Jun. 6, 1995

[51] Int. Cl.[7] ..... C10G 51/06; C10G 35/04; C07C 15/00; C07C 2/52

[52] U.S. Cl. ..... 208/79; 208/63; 208/65; 208/66; 208/78; 208/133; 208/138; 585/412; 585/413; 585/418; 585/419

[58] Field of Search ..... 208/63, 65, 66, 208/78, 79, 133, 138; 585/412, 413, 418, 419

[56] References Cited

U.S. PATENT DOCUMENTS

| | | | |
|---|---|---|---|
| Re. 33,323 | 9/1990 | Roarty et al. | 208/79 |
| 2,867,576 | 1/1959 | Honeycutt | 208/65 |
| 2,882,244 | 4/1959 | Milton | 252/455 |
| 2,944,959 | 7/1960 | Kline et al. | 208/79 |
| 3,003,949 | 10/1961 | Hamilton | 208/79 |
| 3,018,244 | 1/1962 | Stanford et al. | 208/79 |
| 3,130,007 | 4/1964 | Breck | 23/113 |
| 3,172,841 | 3/1965 | Paterson | 208/79 |
| 3,409,540 | 11/1968 | Gould et al. | 208/79 |
| 3,753,891 | 8/1973 | Graven et al. | 208/62 |
| 3,776,949 | 12/1973 | Gelbein et al. | 260/515 P |
| 3,945,913 | 3/1976 | Brennan et al. | 208/137 |
| 4,104,320 | 8/1978 | Bernard et al. | 260/673.5 |
| 4,167,472 | 9/1979 | Dick et al. | 208/80 |
| 4,347,394 | 8/1982 | Detz et al. | 585/419 |
| 4,358,364 | 11/1982 | Klosek et al. | 208/92 |
| 4,594,145 | 6/1986 | Roarty | 208/138 |
| 4,645,586 | 2/1987 | Buss | 208/80 |
| 4,882,040 | 11/1989 | Dessau et al. | 208/138 |
| 4,897,177 | 1/1990 | Nadler | 208/79 |
| 5,013,423 | 5/1991 | Chen et al. | 208/64 |
| 5,037,529 | 8/1991 | Dessau et al. | 208/64 |
| 5,354,933 | 10/1994 | Ohashi et al. | 585/407 |
| 5,386,071 | 1/1995 | Kuchar et al. | 585/413 |
| 5,401,385 | 3/1995 | Schmidt et al. | 208/79 |
| 5,401,386 | 3/1995 | Morrison et al. | 208/65 |
| 5,472,593 | 12/1995 | Gosling et al. | 208/65 |
| 5,496,467 | 3/1996 | Brand et al. | 208/139 |

*Primary Examiner*—Glenn Caldarola
*Assistant Examiner*—Patricia L. Hailey
*Attorney, Agent, or Firm*—Chevron Corporation; W. Keith Turner; E. A. Schaal

[57] ABSTRACT

A full boiling hydrocarbon feed is reformed to enhance para-xylene and benzene yields. First, the hydrocarbon feed is separated into a $C_{5-}$ cut, a $C_6$–$C_7$ cut, and a $C_{8+}$ cut. The $C_6$–$C_7$ cut has less than 5 lv. % of $C_{8+}$ hydrocarbon, and the $C_{8+}$ cut has less than 10 lv. % of $C_{7-}$ hydrocarbon. The $C_6$–$C_7$ cut is subjected to catalytic aromatization at elevated temperatures in a first reformer in the presence of hydrogen and using a non-acidic catalyst comprising at least one Group VIII metal and a non-acidic zeolite support to produce a first reformate stream; and the $C_{8+}$ cut is subjected to catalytic aromatization at elevated temperatures in a second reformer in the presence of hydrogen and using an acidic catalyst comprising at least one Group VIII metal and a metallic oxide support to produce a second reformate stream. Less than 20 wt. % of the total amount of $C_8$ aromatics produced in the first and second reformer is ethylbenzene, and more than 20 wt. % of the total amount of xylenes produced in the first and second reformer are para-xylenes.

5 Claims, 1 Drawing Sheet

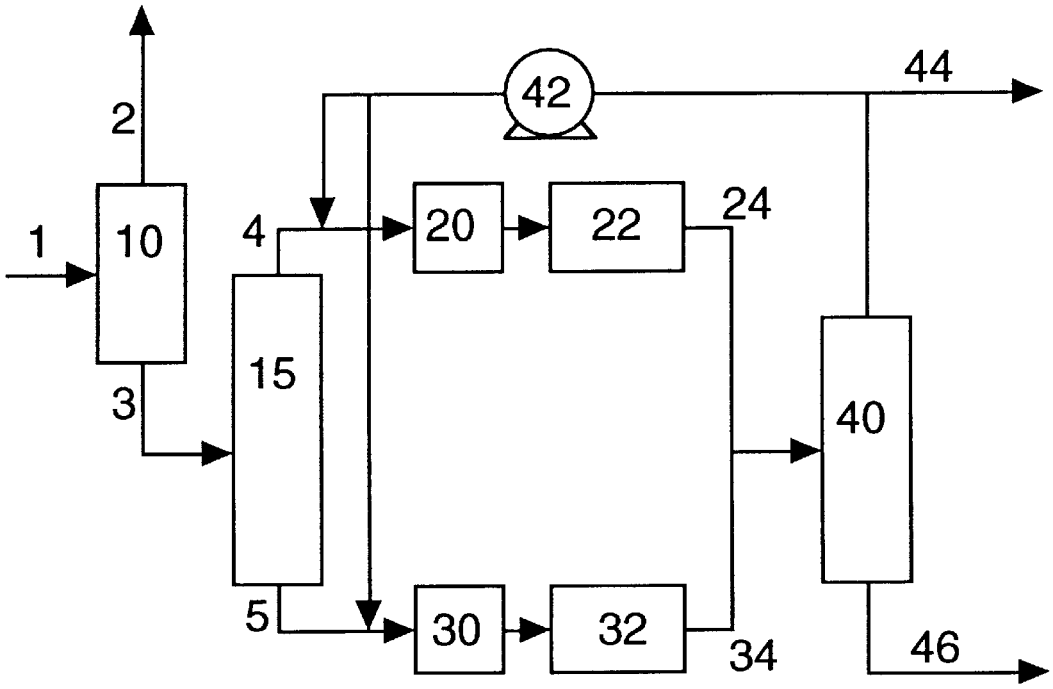
2
1
10
3
4
15
5
42
44
20
22
24
30
32
34
40
46

SPLIT-FEED TWO-STAGE PARALLEL AROMATIZATION FOR MAXIMUM PARA-XYLENE YIELD

The present invention relates to a process for reforming a full-boiling range hydrocarbon feed to enhance para-xylene and benzene production.

BACKGROUND OF THE INVENTION

The reforming of petroleum hydrocarbon streams is an important petroleum refining process that is employed to provide high octane hydrocarbon blending components for gasoline. The process is usually practiced on a straight run naphtha fraction that has been hydrodesulfurized. Straight run naphtha is typically highly paraffinic in nature, but may contain significant amounts of naphthenes and minor amounts of aromatics or olefins. In a typical reforming process, the reactions include dehydrogenation, isomerization, and hydrocracking. The dehydrogenation reactions typically will be the dehydroisomerization of alkylcyclopentanes to aromatics, the dehydrogenation of paraffins to olefins, the dehydrogenation of cyclohexanes to aromatics, and the dehydrocyclization of paraffins to aromatics. The aromatization of the n-paraffins to aromatics is generally considered to be the most important because of the high octane of the resulting aromatic product compared to the low octane ratings for n-paraffins. The isomerization reactions include isomerization of n-paraffins to isoparaffins, and the isomerization of substituted aromatics. The hydrocracking reactions include the hydrocracking of paraffins and hydrodesulfurization of any sulfur that is remaining in the feedstock.

It is well known in the art that several catalysts are capable of reforming petroleum naphthas and hydrocarbons that boil in the gasoline boiling range. Examples of known catalysts useful for reforming include platinum and optionally rhenium or iridium on an alumina support, platinum on zeolite X and zeolite Y, platinum on intermediate pore size zeolites as described in U.S. Pat. No. 4,347,394, and platinum on cation exchanged zeolite L. U.S. Pat. No. 4,104,320 discloses the dehydrocyclization of aliphatic hydrocarbon to aromatics by contact with a catalyst comprising a zeolite L containing alkali metal ions and a Group VIII metal such as platinum.

The conventional reforming catalyst is a bifunctional catalyst that contains a metal hydrogenation-dehydrogenation component, which is usually dispersed on the surface of a porous inorganic oxide support, usually alumina. Platinum has been widely used commercially in the production of reforming catalysts, and platinum on alumina catalysts have been commercially employed in refineries for the past few decades. More recently, additional metallic components have been added to the platinum to further promote the activity or selectivity, or both. Examples of such metallic components are iridium, rhenium, tin and the like. Some catalysts possess superior activity, or selectivity, or both as contrasted with other catalysts. Platinum-rhenium catalysts, for example, possess high selectivity in comparison to platinum catalysts. Selectivity is generally defined as the ability of the catalyst to produce high yields of desirable products with concurrent low production of undesirable products, such as gaseous hydrocarbons.

It is desirable to maximize xylene and benzene production and ultimately para-xylene and benzene production. The problem of how to do this has not been previously solved. The prior art has dealt with the problem of maximizing only benzene production when processing a wide boiling $C_5$–$C_{11}$ naphtha but has not addressed how to maximize first para-xylene production and secondly benzene production. Note that maximizing benzene production should not occur by downgrading $C_8$ and $C_9$ aromatics to benzene. This is especially important as para-xylene has historically commanded a premium above benzene.

There exist several processes for dividing naphtha feedstreams into a higher boiling cut and a lower boiling cut and reforming these cuts separately. U.S. Pat. No. 2,867,576 discloses separating straight run naphtha into lower and higher boiling cuts, in which the higher boiling cuts are reformed with a hydrogenation-dehydrogenation catalyst with the liquid reformate produced being routed to an aromatics separation process. The paraffinic fraction obtained from the separation process is blended with the lower boiling naphtha fraction and the resulting blend is reformed with a reforming catalyst, which may or may not be the same type employed in reforming the high boiling cut.

U.S. Pat. No. 2,944,959 discloses fractionating a full straight run gasoline into a light paraffinic fraction, $C_5$ and $C_6$, that is hydroisomerized with hydrogen and a platinum-alumina catalyst, a middle fraction that is catalytically reformed with hydrogen and a platinum-alumina catalyst, and a heavy fraction that is catalytically reformed with a molybdenum oxide catalyst and recovering the liquid products. U.S. Pat. Nos. 3,003,949, 3,018,244 and 3,776,949 also disclose fractionating a feed into a $C_5$ and $C_6$ fraction, that is isomerized, and a heavier fraction that is reformed.

Other processes for dividing feedstocks and separately treating them include: U.S. Pat. Nos. 3,172,841 and 3,409,540 disclose separating fraction of a hydrocarbon feedstock and catalytically reforming various fractions of the feed; U.S. Pat. No. 4,167,472 discloses separating straight chain from non-straight chain $C_6$–$C_{10}$ hydrocarbons and separately converting to aromatics; and U.S. Pat. No. 4,358,364 discloses catalytically reforming a $C_6$ fraction and producing additional benzene by hydrogasifying a $C_{5-}$ fraction, a fraction with a boiling point above 300° F. and the gas stream produced from catalytic reforming.

U.S. Pat. No. 3,753,891 discloses fractionating a straight run naphtha into a light naphtha fraction containing the $C_6$ and a substantial portion of the $C_7$ hydrocarbons and a heavy naphtha fraction boiling from about 200° to 400° F.; then reforming the light fraction to convert naphthenes to aromatics over a platinum-alumina catalyst or a bimetallic reforming catalyst; separately reforming the heavy faction, then upgrading the reformer effluent of the low boiling fraction over a ZSM-5 type zeolite catalyst to crack the paraffins and recovering an effluent with improved octane rating.

U.S. Pat. No. 4,645,586 discloses parallel reforming of a hydrocarbons feed. In one stream, the hydrocarbons are reformed with an acidic catalyst. In the second stream, the hydrocarbons are reformed with a non-acidic catalyst. That patent is silent as to the composition of each fraction. Preferably, the acidic bi-functional reforming catalyst is not presulfided.

U.S. Pat. No. 4,897,177 discloses using a monofunctional catalyst to reform a hydrocarbon fraction having less than 10% by volume of $C_{9+}$ hydrocarbons. This fraction is either a $C_6$, $C_7$, $C_8$, $C_6$–$C_7$, $C_7$–$C_8$, or $C_6$–$C_8$ fraction, with the most preferred being a $C_6$–$C_8$ fraction. That fraction can contain up to 15 vol. % hydrocarbons outside the named range (col. 3, line 44–49). A heavier fraction can be reformed using a bifunctional catalyst on an acidic metal oxide. That bifunctional catalyst can be a Pt/Sn/alumina catalyst.

U.S. Reissue Patent No. 33,323 discloses solvent extraction of a light fraction of a reformate. The goal of that patent is to maximize benzene production only. A hydrocarbon feed is separated into a lighter fraction (a $C_6$ cut that contains 15–35 lv % $C_{7+}$) and a heavier fraction (all remaining $C_7$ and heavier components). The lighter fraction is reformed in the presence of a non-acidic catalyst to maximize benzene yield. The heavier fraction is reformed in the presence of an acidic catalyst. The reformate from the non-acidic catalyst is introduced into an extraction where an aromatic extract stream and a non-aromatic raffinate stream are recovered. The raffinate stream can be recycled to the feed.

The paper entitled "New Options For Aromatics Production" presented to the 20th Annual 1995 Dewitt Petrochemical Review (Houston, Tex., Mar. 21–23, 1995) by J. D. Swift et al. related recent improvements in UOP's process for the production of benzene and para-xylene. Case studies were presented to demonstrate the benefits of using that process to increase total aromatics production from a fixed quantity of naphtha. One configuration of that process involved a split-feed process, but it is unclear what the composition of each feed was.

SUMMARY OF THE INVENTION

The present invention provides a process for reforming a full boiling hydrocarbon feed to enhance para-xylene and benzene yields.

This invention is based upon the realization that a non-acidic catalyst has an adverse effect on production of para-xylenes. It is thought that the catalyst actually dealkylates those xylenes. Thus the C8+ fraction should not be subjected to a non-acidic catalyst if one is trying to recover xylenes.

In that process, the hydrocarbon feed is separated into a $C_{5-}$ cut, a $C_6$–$C_7$ cut, and a $C_{8+}$ cut, wherein the $C_6$–$C_7$ cut has less than 5 lv. % of $C_{8+}$ hydrocarbon, and wherein the $C_{8+}$ cut has less than 10 lv. % of $C_{7-}$ hydrocarbon. The $C_6$–$C_7$ cut is subjected to catalytic aromatization at elevated temperatures in a first reformer in the presence of hydrogen and using a non-acidic catalyst comprising at least one Group VIII metal and a non-acidic zeolite support, preferably platinum on a non-acidic zeolite L support, to produce a first reformate stream. The $C_{8+}$ cut is subjected to catalytic aromatization at elevated temperatures in a second reformer in the presence of hydrogen and using an acidic catalyst comprising at least one Group VIII metal and a metallic oxide support, preferably a non-presulfided acidic catalyst comprising platinum and tin on an alumina support, to produce a second reformate stream. Less than 20 wt. % of the total amount of $C_8$ aromatics produced in the first and second reformer is ethylbenzene, and more than 20 wt. % of the total amount of xylenes produced in the first and second reformer are para-xylenes.

Preferably, the first reformate stream and the second reformate stream are combined to form a combined reformate stream, the combined reformate stream is separated into a light fraction and a heavy fraction, and at least part of the light fraction is recycled either to the hydrocarbon feed or to at least one of the reformers.

From our experimental studies where we have investigated the aromatization of a wide-boiling range naphtha over a nonacidic zeolite such as Pt/K—Ba L zeolite or Pt/K L zeolite with F and Cl, we have found that these non-acidic catalysts are more efficient than the standard bi-functional catalysts at aromatizing $C_6$'s and $C_7$'s to the corresponding aromatic. However, we have also found that the standard reforming bi-functional catalysts such as Pt/Sn/Cl on alumina are more efficient than the non-acidic zeolites at aromatizing $C_8$'s and $C_9$'s to the corresponding aromatic.

For example, at $C_8$ paraffin and napththene (P+N) conversions of 92.9%, the selectivity to $C_8$ aromatics is about 50% with the non acidic zeolite when processing a $C_6$–$C_{10}$ paraffinic naphtha. When the same naphtha is processed over a bi-functional aromatization catalyst such as Pt/Sn/Cl on alumina the selectivity to $C_8$ aromatics is about 80% at $C_8$ (P+N) conversions of 90+%. The lower C8 aromatics yield with the non-acidic zeolite is due to hydro-dealkylation of the C8 aromatics to benzene and toluene.

Furthermore, when the $C_6$–$C_{10}$ naphtha is processed over a non-acidic zeolite, not only is the yield of $C_8$ aromatics lower, 19 wt % versus 24 wt % with a bi-functional catalyst, but also the $C_8$ aromatics stream is of a poorer quality. The $C_8$ aromatics stream made with the non-acidic zeolite contains 30% ethylbenzene compared to about 16% produced with the bi-functional catalyst. Thus the xylene yield is lower, 13 wt % versus 20 wt % with the bi-functional catalyst. In other words, the bifunctional catalyst makes 50% more xylenes.

In addition, with the non-acidic zeolite, the para-xylene concentration on a xylene basis is low, 12% compared to 20% with the bi-functional catalyst. This latter value is very close to the equilibrium value of 23% at the operating temperature of the aromatization stage.

Thus from a $C_8$ aromatization standpoint, the bi-functional catalyst, has a higher $C_8$ aromatics yield, a higher xylene yield, and a lower yield of ethylbenzene than the non-acidic zeolite. Also, the bifunctional catalyst makes a xylene stream with a higher concentration of para-xylene than the non-acidic zeolite. All of these are advantages to the para-xylene producer as they minimize capital and operating cost.

A further benefit of the bi-functional catalysts is that the conversion and selectivity of $C_9$ paraffins and naphthenes to the $C_9$ aromatics is much higher. Thus the overall $C_9$ aromatics yield is about 10 wt % compared to about 4.0 wt % with the non-acidic zeolite. In addition, the $C_9$ aromatics produced with the bi-functional catalyst contain about 55% trimethylbenzenes and about 35% methyl-ethylbenzenes. This compares to about 20% trimethylbenzenes and about 46% methyl-ethylbenzenes with the non-acidic zeolite. The $C_9$ aromatics are converted to xylenes and benzene by transalkylation with toluene. In this process, the trimethylbenzenes are the preferred species, as they yield two moles of xylenes per mole of trimethylbenzenes and toluene, whereas methyl-ethylbenzenes can yield one mole of xylenes and ethylbenzenes, which is undesirable, or alternatively one mole of benzene and a $C_{10}$ aromatic. So not only does the bi-functional catalyst make more $C_9$ aromatics, but they are of a better quality from a xylenes and ultimately para-xylene production standpoint.

BRIEF DESCRIPTION OF THE DRAWINGS

In order to assist the understanding of this invention, reference will now be made to the appended drawings. The drawings are exemplary only, and should not be construed as limiting the invention.

FIG. 1 shows a flow diagram of one embodiment of the present invention.

DETAILED DESCRIPTION OF THE INVENTION

In its broadest aspect, the present invention involves a process for reforming a full boiling hydrocarbon feed to enhance para-xylene and benzene yields.

In that process the hydrocarbon feed is separated into a $C_{5-}$ cut, a $C_6$–$C_7$ cut, and a $C_{8+}$ cut. The $C_6$–$C_7$ cut has less than 5 lv. % of $C_{8+}$ hydrocarbon, and the $C_{8+}$ cut has less than 10 lv. % of $C_{7-}$ hydrocarbon.

The $C_6$–$C_7$ cut is subjected to catalytic aromatization at elevated temperatures in a first reformer in the presence of hydrogen and using a non-acidic catalyst comprising at least one Group VIII metal and a non-acidic zeolite support to produce a first reformate stream.

The $C_{8+}$ cut is subjected to catalytic aromatization at elevated temperatures in a second reformer in the presence of hydrogen and using an acidic catalyst comprising at least one Group VIII metal and a metallic oxide support to produce a second reformate stream.

Less than 20 wt. % of the total amount of $C_8$ aromatics produced in the first and second reformer is ethylbenzene, and more than 20 wt. % of the total amount of xylenes produced in the first and second reformers are para-xylenes.

To minimize capital investment and maximize aromatics yield, both reformers operate at a common operating pressure that allows linking of the two reformers and where possible common equipment can be used such as recycle gas compressor, net gas booster compressor, separator and depentanizer. Thus essentially we have one aromatization plant. This processing scheme solves the problem of how to maximize benzene and particularly para-xylene production at low capital cost.

NON-ACIDIC CATALYSTS

One of the catalysts used must be a non-acidic catalyst having a non-acidic zeolite support charged with one or more dehydrogenating constituents. Among the zeolites useful in the practice of the present invention are zeolite L, zeolite X, and zeolite Y. These zeolites have apparent pore sizes on the order of 7 to 9 Angstroms.

Zeolite L is a synthetic crystalline zeolitic molecular sieve which may be written as:

$$(0.9–1.3)M_{2/n}O:Al_2O_3(5.2–6.9)SiO_2:yH_2O$$

wherein M designates a cation, n represents the valence of M, and y may be any value from 0 to about 9. Zeolite L, its X-ray diffraction pattern, its properties, and method for its preparation are described in detail in U.S. Pat. No. 3,216,789. U.S. Pat. No. 3,216,789 is hereby incorporated by reference to show the preferred zeolite of the present invention. The real formula may vary without changing the crystalline structure; for example, the mole ratio of silicon to aluminum (Si/Al) may vary from 1.0 to 3.5.

Zeolite X is a synthetic crystalline zeolitic molecular sieve which may be represented by the formula:

$$(0.7–1.1)M_{2/n}O:Al_2O_3:(2.0–3.0)SiO_2:yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244. U.S. Pat. No. 2,882,244 is hereby incorporated by reference to show a zeolite useful in the present invention.

Zeolite Y is a synthetic crystalline zeolitic molecular sieve which may be written as:

$$(0.7–1.1)Na_2O:Al_2O_3:xSiO_2:yH_2O$$

wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007 is hereby incorporated by reference to show a zeolite useful in the present invention.

The preferred non-acidic catalyst is a type L zeolite charged with one or more dehydrogenating constituents.

The zeolitic catalysts according to the invention are charged with one or more Group VIII metals, e.g., nickel, ruthenium, rhodium, palladium, iridium or platinum.

The preferred Group VIII metals are iridium and particularly platinum, which are more selective with regard to dehydrocyclization and are also more stable under the dehydrocyclization reaction conditions than other Group VIII metals.

The preferred percentage of platinum in the dehydrocyclization catalyst is between 0.1% and 5%, the lower limit corresponding to minimum catalyst activity and the upper limit to maximum activity. This allows for the high price of platinum, which does not justify using a higher quantity of the metal since the result is only a slight improvement in catalyst activity.

Group VIII metals are introduced into the large-pore zeolite by synthesis, impregnation or exchange in an aqueous solution of appropriate salt. When it is desired to introduce two Group VIII metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion exchange process, platinum can be introduced by using cationic platinum complexes such as tetrammineplatinum (II) nitrate.

A preferred, but not essential, element of the present invention is the presence of an alkaline earth metal in the dehydrocyclization catalyst. That alkaline earth metal can be either barium, strontium or calcium. Preferably the alkaline earth metal is barium. The alkaline earth metal can be incorporated into the zeolite by synthesis, impregnation or ion exchange. Barium is preferred to the other alkaline earths because the resulting catalyst has high activity, high selectivity and high stability.

An inorganic oxide may be used as a carrier to bind the large-pore zeolite containing the Group VIII metal. The carrier can be a natural or a synthetically produced inorganic oxide or combination of inorganic oxides. Typical inorganic oxide supports which can be used include clays, alumina, and silica, in which acidic sites are preferably exchanged by cations that do not impart strong acidity.

The non-acidic catalyst can be employed in any of the conventional types of equipment known to the art. It may be employed in the form of pills, pellets, granules, broken fragments, or various special shapes, disposed as a fixed bed within a reaction zone, and the charging stock may be passed therethrough in the liquid, vapor, or mixed phase, and in either upward or downward flow. Alternatively, it may be prepared in a suitable form for use in moving beds, or in fluidized-solid processes, in which the charging stock is passed upward through a turbulent bed of finely divided catalyst.

ACIDIC CATALYSTS

An acidic catalyst is used in conjunction with the non-acidic catalyst. The acidic catalyst can comprise a metallic oxide support having disposed therein a Group VIII metal. Suitable metallic oxide supports include alumina and silica.

Preferably, the acidic catalyst comprises a metallic oxide support having disposed therein in intimate admixture a Group VIII metal (preferably platinum) and a Group VIII metal promoter, such as rhenium, tin, germanium, cobalt, nickel, iridium, rhodium, ruthenium and combinations thereof. More preferably, the acidic catalyst comprises an alumina support, platinum, and rhenium. A preferred acidic catalyst comprises platinum and tin on an alumina support.

Preferably, the acidic catalyst has not been presulfided before use. This is important to avoid sulfur contamination of the non-acidic catalyst by recycle of part of the reformate produced by the acidic catalyst. On the other hand, if one can insure no sulfur contamination of the non-acidic catalyst from the reformate produced by the acidic catalyst, then one might be able to use a presulfided catalyst, such as Pt/Re on alumina.

REFORMING CONDITIONS

The reforming in both reformers is carried out in the presence of hydrogen at a pressure adjusted to favor the dehydrocyclization reaction thermodynamically and to limit undesirable hydrocracking reactions. The pressures used preferably vary from 1 atmosphere to 500 psig, more preferably from 50 to 300 psig, the molar ratio of hydrogen to hydrocarbons preferably being from 1:1 to 10:1, more preferably from 2:1 to 6:1.

In the temperature range of from 400° C. to 600° C., the dehydrocyclization reaction occurs with acceptable speed and selectivity. If the operating temperature is below 400° C., the reaction speed is insufficient and consequently the yield is too low for industrial purposes. When the operating temperature of dehydrocyclization is above 600° C., interfering secondary reactions such as hydrocracking and coking occur, and substantially reduce the yield. It is not advisable, therefore, to exceed the temperature of 600° C. The preferred temperature range (430° C. to 550° C.) of dehydrocyclization is that in which the process is optimum with regard to activity, selectivity and the stability of the catalyst.

The liquid hourly space velocity of the hydrocarbons in the dehydrocyclization reaction is preferably between 0.3 and 5.

EXAMPLES

The invention will be further illustrated by following examples, which set forth particularly advantageous method embodiments. While the Examples are provided to illustrate the present invention, they are not intended to limit it.

EXAMPLE 1

Referring to FIG. 1, in one embodiment, a full boiling hydrocarbon feed 1 is fed to a depentanizer 10 to produce a $C_{5-}$ fraction stream 2 and a $C_{6+}$ stream 3. The $C_{6+}$ stream 3 is fed to splitter 15 to produce an overhead $C_6$–$C_7$ cut 4 with nil $C_{8+}$, and a bottoms $C_{8+}$ cut 5 with all the $C_{8+}$ material. Note that no $C_{9+}$ material is in the overhead $C_6$–$C_7$ cut 4. The bottoms $C_{8+}$ cut 5 contains less than 10 lv. % of $C_{7-}$ hydrocarbon. The quantity of feed to the overhead and bottoms cut, as well as the composition of each cut, is shown in Table I.

TABLE I

| | Feed | Overhead | | Bottoms | |
|---|---|---|---|---|---|
| | wt % | wt % feed | comp wt % | wt % feed | comp wt % |
| n-paraffin | | | | | |
| $C_5$ | 1.21 | 1.21 | 2.43 | — | — |
| $C_6$ | 13.49 | 13.49 | 27.06 | — | — |
| $C_7$ | 8.99 | 8.99 | 18.03 | 0.47 | 0.93 |
| $C_8$ | 10.60 | — | — | 10.60 | 21.13 |
| $C_9$ | 3.69 | — | — | 3.69 | 7.36 |
| i-paraffin | | | | | |
| $C_5$ | 0.21 | 0.21 | 0.42 | — | — |
| $C_6$ | 10.06 | 10.06 | 20.17 | — | — |
| $C_7$ | 5.76 | 5.76 | 11.55 | — | — |
| $C_8$ | 11.28 | — | — | 11.28 | 22.50 |
| $C_9$ | 6.12 | — | — | 6.12 | 12.21 |
| $C_{10}$ | 0.42 | — | — | 0.42 | 0.84 |
| Olefins | 0.64 | 0.64 | 1.28 | — | — |
| Naphthene | | | | | |
| $C_5$ | 0.40 | 0.40 | 0.80 | — | — |
| $C_6$ | 3.28 | 3.28 | 6.58 | — | — |
| $C_7$ | 5.19 | 4.93 | 9.89 | 0.26 | 0.52 |
| $C_8$ | 6.01 | — | — | 6.01 | 11.99 |
| $C_9$ | 2.80 | — | — | 2.80 | 5.58 |
| Aromatics | | | | | |
| $C_6$ | 0.89 | 0.89 | 1.79 | — | — |
| $C_7$ | 2.28 | — | — | 2.28 | 4.35 |
| $C_8$ | 5.88 | — | — | 5.88 | 11.73 |
| $C_{9+}$ | 0.33 | — | — | 0.33 | 0.66 |

The overhead $C_6$–$C_7$ cut 4 is passed through a sulfur sorber 20 to protect against sulfur/$H_2S$ contamination, and is processed over a first reformer 22 which contains a non-acidic zeolite, such as Pt/K—Ba zeolite L, or Pt/K zeolite L with and without fluorine and/or chlorine. Operating conditions of the first reformer are 75 psig, 1.0 LHSV$^{-hr-1}$, a hydrogen/hydrocarbon ($H_2$/HC) ratio of 5/1 mole/mole and a target $C_6$+$C_7$ normal and iso-paraffin (n+i) paraffin conversion of 90–93%. The $C_6$ and $C_7$ naphthenes as cyclohexanes are fully converted while the cyclopentanes are not fully converted. The individual paraffin, iso-paraffin and naphthene conversion by carbon number in the first reformer is shown in Table II with the associated selectivity to the corresponding aromatic. The first reformate stream 24, from the first reformer 22, has a benzene yield of 21.0 wt. % of splitter feed and a toluene yield of 14.8 wt. % of splitter feed.

The bottoms $C_{8+}$ cut 5 is passed through a sulfur sorber 30 to protect against sulfur/$H_2S$ contamination, and is processed over a second reformer 32 which contains an acidic bi-functional aromatization catalyst which does not need to be sulfided, such as Pt/Sn/Cl on alumina. Operating conditions of the second reformer are 75 psig, 1.0 LHSV$^{-hr-1}$, $H_2$/HC mole ratio of 5/1 and a $C_8$+$C_9$ (n+i)paraffin conversion of 95–100%. The $C_8$ and $C_9$ naphthenes are also fully converted. The paraffin and naphthene conversion and selectivity used are shown in Table II.

TABLE II

| | Conversion % | Selectivity % |
|---|---|---|
| 1st Reformer | | |
| $C_6$ n paraffins | 91.0 | 92.9 |
| $C_7$ n paraffins | 98.0 | 84.0 |
| $C_6$ demethylbutane | 40.0 | — |

TABLE II-continued

| | Conversion % | Selectivity % |
|---|---|---|
| $C_6$ methylpentane | 91.0 | 92.9 |
| $C_7$ iso-parffins | 98.0 | 84.0 |
| $C_6$ napththenes | 89.1 | 92.9 |
| $C_7$ napththenes | 100.0 | 84.0 |
| 2nd Reformer | | |
| $C_7$ (n + i) paraffins | 88.0 | 74.0 |
| $C_8$ (n + i) paraffins | 100.0 | 81.0 |
| $C_9$ (n + i) paraffins | 100.0 | 92.0 |
| $C_7$ napththenes | 100.0 | 74.0 |
| $C_8$ napththenes | 100.0 | 81.0 |
| $C_9$ napththenes | 100.0 | 92.0 |

The first reformate stream 24 from the first reformer 22 is combined with the second reformate stream 34 from the second reformer 32 and sent to a common liquid-gas separator 40 where the $H_2$ produced is recovered along with $C_1$–$C_3$ gas and recycled to each reformer via a common recycle compressor 42. Excess $H_2$ and $C_1$–$C_3$ exits the system via line 44 for subsequent recovery of pure $H_2$, and $C_1$–$C_3$ as fuel gas.

One of the benefits of having a common separator is that it then allows for a common recycle compressor that operates on the off gas from the separator. Alternatively we could also have two separate recycle compressors (one for each reformer) to maintain operating flexibility. A benefit of a common separator is that it reduces capital cost, which is further reduced if a common recycle compressor is used. A further benefit is that the gas produced in the non-acidic reformer will have a higher hydrogen purity than the gas produced in the acidic reformer. By combining these off-gases the acidic reformer will be provided with a gas that has a higher hydrogen purity. This can be taken advantage of by reducing fouling rate or lowering recycle compressor capital and operating cost.

The liquid 46 from the separator 40 can be sent to a depentanizer to recover a $C_4$–$C_5$ overhead cut and a $C_{6+}$ bottoms cut, and the components of the C6+ stream can be processed to separate the stream into component streams.

While the present invention has been described with reference to specific embodiments, this application is intended to cover those various changes and substitutions that may be made by those skilled in the art without departing from the spirit and scope of the appended claims.

What is claimed is:

1. A process for reforming a full boiling hydrocarbon feed to enhance para-xylene and benzene yields comprising:

(a) separating the hydrocarbon feed into a $C_{5-}$ cut, a $C_6$–$C_7$ cut, and a $C_{8+}$ cut, wherein the $C_6$–$C_7$ cut has less than 5 lv. % of $C_{8+}$ hydrocarbon, and wherein the $C_{8+}$ cut has less than 10 lv. % of $C_{7-}$ hydrocarbon;

(b) subjecting the $C_6$–$C_7$ cut to catalytic aromatization at elevated temperatures in a first reformer in the presence of hydrogen and using a non-acidic catalyst comprising at least one Group VIII metal and non-acidic zeolite support to produce a first reformate stream containing less than 5 lv % $C_8$ aromatics including xylenes; and (c) subjecting the $C_{8+}$ cut to catalytic aromatization at elevated temperatures in a second reformer in the presence of hydrogen and using an acidic catalyst comprising at least one Group VIII metal and a metallic oxide support to produce a second reformate stream containing $C_8$ aromatics including xylenes;

wherein less than 20 wt. % of the total amount of $C_8$ aromatics produced in the first and second reformer is ethylbenzene, and wherein more than 20 wt. % of the total amount of xylenes produced in the first and second reformer are para-xylenes.

2. A process for reforming according to claim 1 wherein the non-acidic catalyst comprises platinum on a non-acidic zeolite L.

3. A process for reforming according to claim 2 wherein the acidic catalyst is not presulfided.

4. A process for reforming according to claim 3 wherein the acidic catalyst comprises platinum and tin on an alumina support.

5. A process for reforming according to claim 3 wherein the process further comprises the steps of:

(d) combining the first reformate stream and the second reformate stream to form a combined reformate stream;

(e) separating the combined reformate stream into a light fraction and a heavy fraction;

(f) recycling at least part of the light fraction either to the hydrocarbon feed or to at least one of the reformers.

* * * * *